US007866478B2

(12) United States Patent
Rohrbach et al.

(10) Patent No.: US 7,866,478 B2
(45) Date of Patent: Jan. 11, 2011

(54) PACKAGING FOR AN ARTICLE

(75) Inventors: Matthew Dean Rohrbach, San Francisco, CA (US); Carter Multz, San Jose, CA (US)

(73) Assignee: Apple Inc., Cupertino, CA (US)

( * ) Notice: Subject to any disclaimer, the term of this patent is extended or adjusted under 35 U.S.C. 154(b) by 40 days.

(21) Appl. No.: 12/047,533

(22) Filed: Mar. 13, 2008

(65) Prior Publication Data

US 2009/0230016 A1 Sep. 17, 2009

(51) Int. Cl.
*B65D 81/02* (2006.01)

(52) U.S. Cl. ..... 206/586; 206/588; 248/345.1

(58) Field of Classification Search ..... 206/586, 206/588, 591, 592, 593, 594, 453, 754, 755; 248/345.1; 229/199; 428/188, 189, 188.9, 428/345.1

See application file for complete search history.

(56) References Cited

U.S. PATENT DOCUMENTS

| | | | | | |
|---|---|---|---|---|---|
| 2,000,158 | A * | 5/1935 | Black et al. | ..... | 206/586 |
| 2,663,417 | A * | 12/1953 | Kincaid | ..... | 206/453 |
| 2,979,246 | A * | 4/1961 | Liebeskind | ..... | 206/523 |
| 3,047,137 | A * | 7/1962 | Kindseth | ..... | 206/592 |
| 3,587,838 | A * | 6/1971 | Miyata | ..... | 206/583 |
| 3,752,384 | A * | 8/1973 | Siburn | ..... | 206/521 |
| 3,807,622 | A * | 4/1974 | Belcher et al. | ..... | 206/421 |
| 4,482,054 | A * | 11/1984 | Gardner | ..... | 206/594 |
| 4,742,916 | A * | 5/1988 | Galea | ..... | 206/586 |
| 4,801,018 | A * | 1/1989 | Wilde | ..... | 206/586 |
| 4,869,369 | A * | 9/1989 | Turngren | ..... | 206/523 |
| 4,877,673 | A * | 10/1989 | Eckel et al. | ..... | 428/172 |
| 4,883,179 | A * | 11/1989 | Dionne | ..... | 206/523 |
| 5,071,009 | A * | 12/1991 | Ridgeway | ..... | 206/586 |
| 5,335,770 | A | 8/1994 | Baker et al. | | |
| 5,657,955 | A * | 8/1997 | Adams | ..... | 248/345.1 |
| 5,711,426 | A | 1/1998 | Kuhn et al. | | |
| 6,073,770 | A * | 6/2000 | Park | ..... | 206/522 |
| 6,142,304 | A * | 11/2000 | Moren et al. | ..... | 206/587 |
| 6,261,653 | B1 * | 7/2001 | Smith | ..... | 428/35.7 |
| 6,520,337 | B2 * | 2/2003 | Smith | ..... | 206/592 |
| 6,629,608 | B2 * | 10/2003 | Hurley et al. | ..... | 206/586 |
| 6,705,469 | B2 * | 3/2004 | Slot | ..... | 206/587 |
| 6,722,502 | B1 * | 4/2004 | Newman | ..... | 206/586 |
| 6,840,381 | B2 * | 1/2005 | Stephens | ..... | 206/589 |
| 7,014,047 | B2 | 3/2006 | Stapleton | | |
| 7,216,765 | B2 | 5/2007 | Markert et al. | | |
| 7,383,952 | B2 | 6/2008 | Kruelle et al. | | |
| 2003/0038054 | A1 * | 2/2003 | Hurley et al. | ..... | 206/586 |
| 2004/0262193 | A1 | 12/2004 | Korhonen | | |
| 2005/0211600 | A1 * | 9/2005 | Saito | ..... | 206/586 |
| 2006/0243636 | A1 * | 11/2006 | Robichaud et al. | ..... | 206/586 |

* cited by examiner

*Primary Examiner*—Ehud Gartenberg
*Assistant Examiner*—King M Chu
(74) *Attorney, Agent, or Firm*—Sterne, Kessler, Goldstein & Fox PLLC

(57) ABSTRACT

Packaging for use with an article of manufacture, which includes a first member having a first interior cavity for receiving a first portion of the article, a second member having a second interior cavity for receiving a second portion of the article, and a molded hinge connecting the first member and the second member. The first member may be attached to an outer container for holding the article.

18 Claims, 6 Drawing Sheets

PACKAGING FOR AN ARTICLE

BACKGROUND OF THE INVENTION

1. Field of the Invention

The present invention generally relates to packaging, and more particularly, to packaging for an article of manufacture.

2. Background Art

A main purpose of packaging is to protect a product during shipment and merchandising. It is desirable for packaging to be strong enough to prevent significant damage caused by compressive forces that may be encountered, while at the same time being relatively simple and affordable to mass produce.

Another purpose for packaging may be to generate consumer interest and to project a positive image and brand of the company who produces the product. Consumer products companies may want to leave purchasers with an environmentally-friendly impression of the company by providing recyclable and re-usable product packaging. In addition, packaging that has fewer pieces and is easier for the purchaser to disassemble may result in less waste, and may appeal to consumers. Branding can be particularly important in the highly competitive marketplace of consumer electronics, such as computers like the MacBook® Pro widescreen notebooks sold by Apple, Inc. of Cupertino, Calif. Consumers of such devices tend to be discriminating and savvy, and may expect product packaging to have the same unique qualities as the products themselves.

BRIEF SUMMARY OF THE INVENTION

Embodiments of the present invention relate to packaging for use with an article, comprising: a first member having a first interior cavity for receiving a first portion of the article; a second member having a second interior cavity for receiving a second portion of the article; and a molded hinge connecting the first member and the second member.

Embodiments of the present invention also relate to a packaging assembly for use with an article of manufacture comprising a container for holding the article, the container having a flap; and a plurality of corner protectors, each corner protector comprising: a first member having a first interior space for receiving a first portion of the article; a second member having a second interior space for receiving a second portion of the article; and a molded hinge connecting the first member and the second member. The first member may be attached to the flap of the container such that when the flap is opened the first member rotates about the molded hinge.

Embodiments of the present invention further relate to packaging for protecting a corner of an article of manufacture disposed in an outer container, the packaging comprising: a first member having a first cavity formed therein for receiving a first side of the article and a flange attached to the outer container; a second member having a second cavity formed therein for receiving a second side of the article; and a hinge connecting the first member and the second member, wherein the packaging is integrally molded as a unitary piece.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE INVENTION

Figure 1:
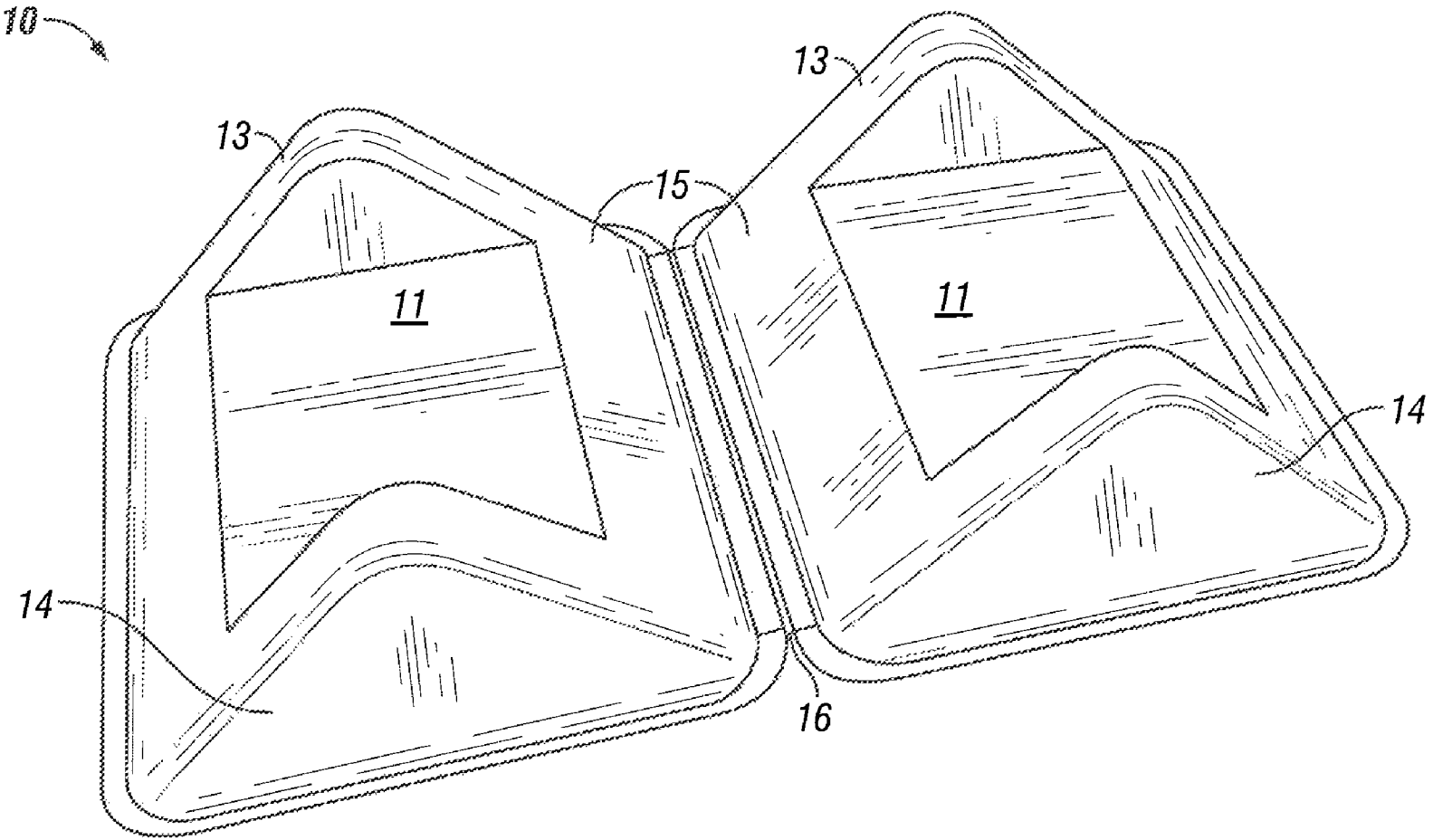
FIG. 1 is a perspective view of a corner protector for packaging according to an embodiment of the present invention.

The present invention will now be described in detail with reference to embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order not to unnecessarily obscure the present invention.

With reference to FIGS. 1-5, an embodiment of the present invention includes a corner protector 10 packaging component for protecting a corner of an article of manufacture during shipping and/or merchandising. As will be described in detail below, the corner protector 10 may be used in a packaging assembly 20 including an article of manufacture 40 and an outer container 30, such as, for example, a box. The corner protector 10 may be disposed between a portion of the article of manufacture 40 (e.g., a corner) and the outer container 30. In this manner, the corner protector 10 may provide an air gap between the article 40 and the outer container 30 in order to protect the article from damage caused by crushing. The outer container 30 may be made of, for example, paper, cardboard, metal, or any other material suitable for packaging.

Figure 2:
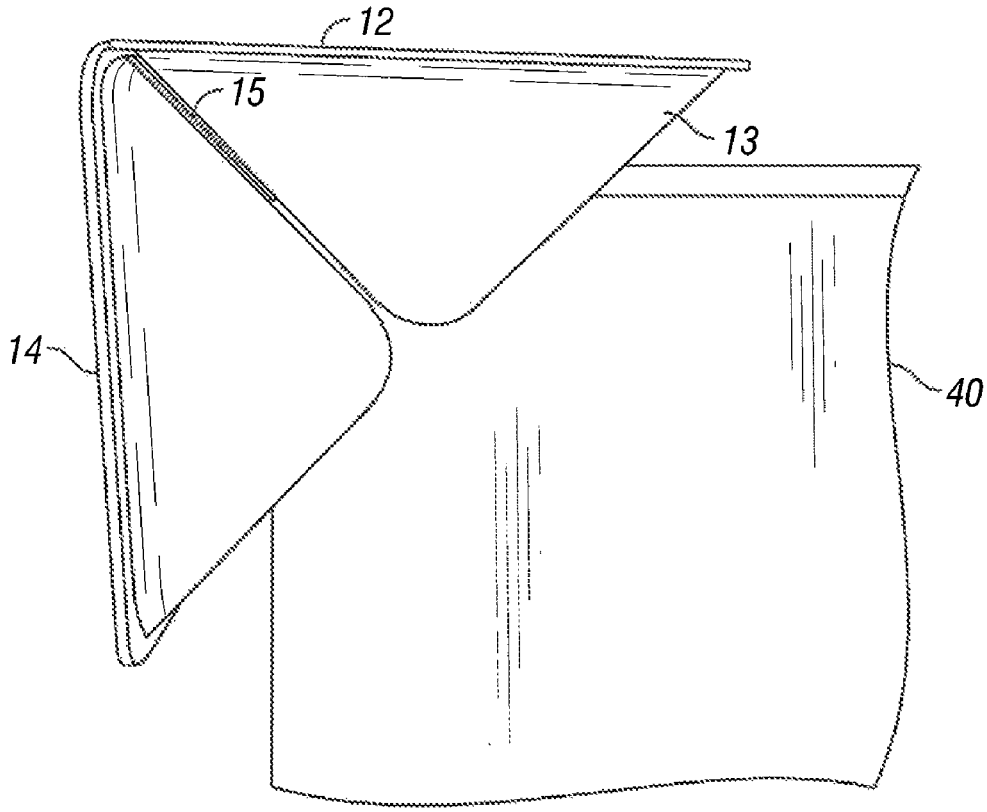
FIG. 2 is a side view of the corner protector for packaging according to an embodiment of the present invention.

As shown in FIG. 1, the corner protector 10 comprises a first member 12 and a second member 14 connected by a hinge 16. The first member 12 and the second member 14 are adapted to rotate about the hinge 16 between an open position (as shown in FIG. 1) and a closed position about the article 40 (FIG. 2). Each of the first member 12 and the second member 14 includes two sidewalls 13 which define a cavity 11 intermediate the two sidewalls. Each cavity 11 may be adapted to receive a portion of the article of manufacture 40. For example, as shown in FIG. 2, the cavity 11 of the first member 12 and the cavity 11 of the second member 14 may define two planes so as to receive a corner (i.e., adjacent sides) of the article 40. Thus, when the corner protector 10 is in the closed position, the shape of the inside of the corner protector 10 may correspond to the outer shape of the article 40.

In one embodiment of the present invention, the first member 12 and the second member 14 further include a shoulder 15. As shown in FIG. 2, the shoulders 15 may comprise angled surfaces such that the shoulder 15 of the first member 12 may be adapted to cooperate with the shoulder 15 of the second member 14 when the corner protector 10 is in a closed position about a portion of the article 40. In this embodiment, the shoulders 15 come together to form a corner, and, thus, the first member 12 may be perpendicular to the second member 14.

Figure 3:
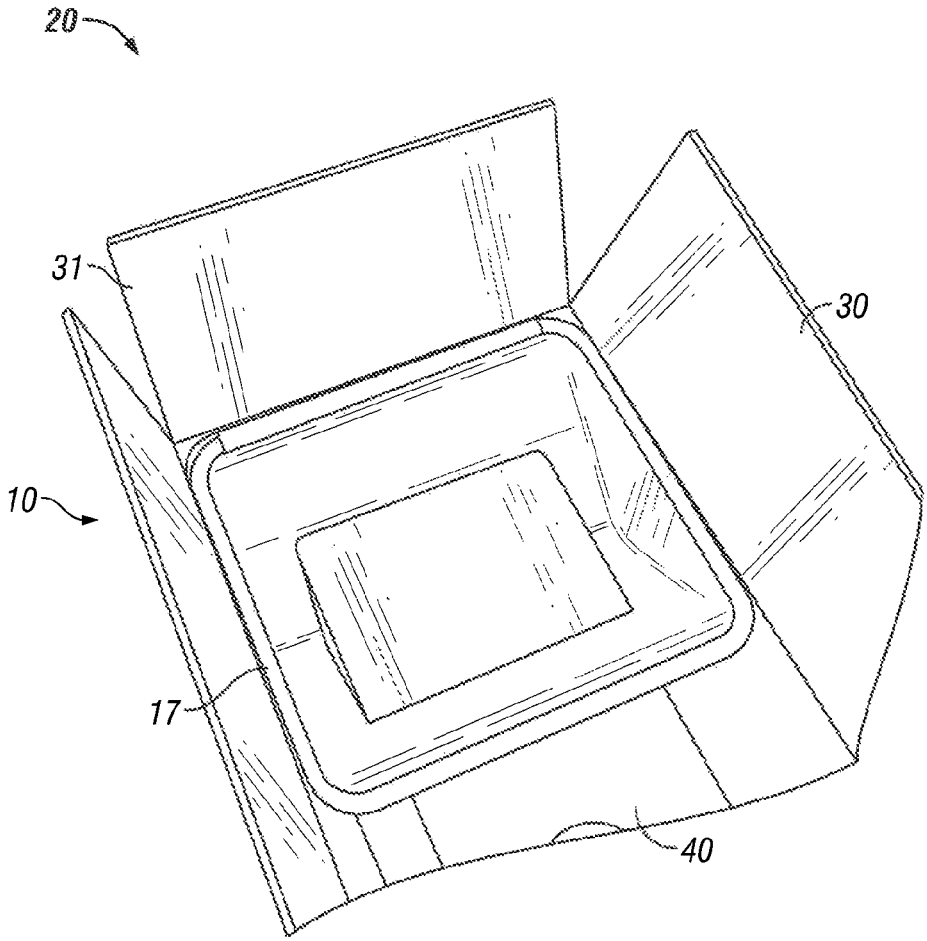
FIG. 3 is a perspective view of packaging according to an embodiment of the present invention.
Figure 4:
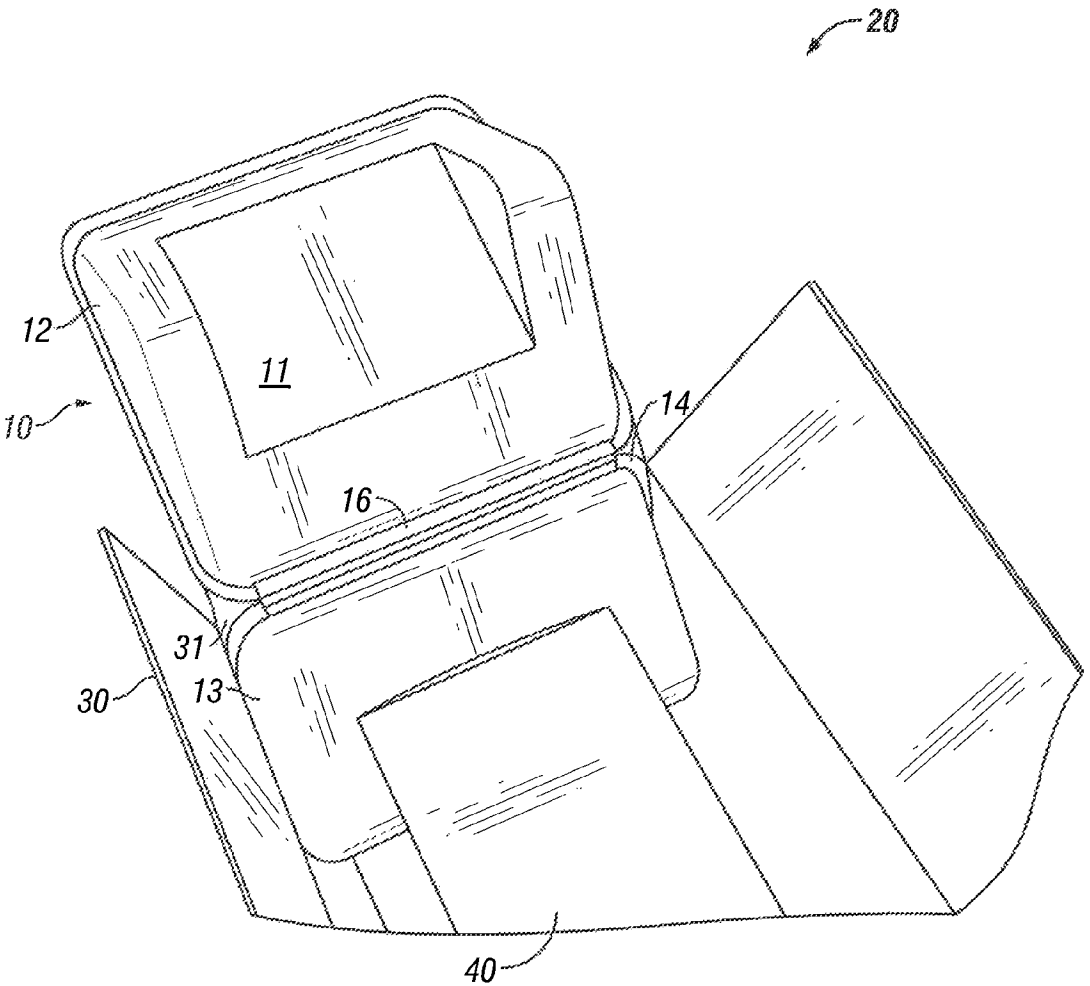
FIG. 4 is a perspective view of packaging according to an embodiment of the present invention.

As best shown in FIG. 3, in one embodiment, a flange 17 may be formed on the first member 12 and/or the second member 14 (shown unattached to the outer container 30 in FIG. 3 for illustrative purposes). The flange 17 may provide an attachment surface for attaching the first member 12 and/or the second member 14 to the outer container 30. The flange 17 may be attached to a portion of the outer container 30, such as, for example, a flap 31 of the container. As shown in FIG. 4, the flange 17 may be attached to the outer container 30 such that when the outer container 30 is opened, the first member 12 remains attached to the outer container 30 and is rotated about the hinge 16. The first member 12 may be correspondingly pulled away from the article 40, thereby exposing the article and facilitating its removal from the container. As a result, there may be less damage to the corner protector 10 during disassembly of the packaging assembly 20, which may allow for the corner protector 10 to be re-used. Further, the flange 17 may formed so as to provide rigidity and strength to the corner protector 10.

In one embodiment of the present invention, the first member 12 and the second member 14 further include a shoulder 15. As shown in FIG. 2, the shoulders 15 may comprise angled surfaces such that the shoulder 15 of the first member 12 may be adapted to cooperate with or abut the shoulder 15 of the second member 14 when the corner protector 10 is in a closed position about a portion of the article 40. In this embodiment, the shoulders 15 come together to form a corner, and, thus, the first member 12 may be perpendicular to the second member 14.

In one embodiment, the flange 17 may be attached to the outer container 30 using an adhesive, such as glue. Other suitable means for attaching the flange 17 to the outer container 30, including, but not limited to, double-sided tape and staples, may be used.

In one embodiment of the present invention, the flange 17 may comprise a continuous surface formed around the perimeter of the first member 12 and/or the second member 14. In alternative embodiments, the flange 17 may comprise a segmented surface formed around one or more portions of the perimeter of the first member 12 and/or the second member 14. For example, the flange 17 may comprise a tab on the sides of the first member 12 and/or the second member 14.

The flange 17 may be sized such that there is sufficient surface area to attach to the outer container 30 properly. In some embodiments, the flange 17 may extend inwardly in order to create a larger attachment surface and may be sized to provide increased strength. In another embodiment, the flange 17 may extend across the entire width of the corresponding member.

The size and shape of the corner protector 10 may be widely varied to accommodate a wide variety of article shapes and sizes. With reference to FIG. 2, for example, in one embodiment the corner protector 10 may be adapted to receive a rectangular-shaped article such as a MacBook® Pro widescreen notebook produced by Apple, Inc. In other embodiments, the corner protector 10 may be adapted to be used with articles of manufacture having shapes that do not have a clearly defined corner, such as a cylindrical or round object, or other irregular shapes for packaging.

In one embodiment, the first member 12 and the second member 14 are substantially similar in size and shape. In alternative embodiments, it is contemplated that the first member 12 and the second member 14 may have different sizes and/or shapes. For example, the first member 12 may be longer or shorter than the second member 14, and/or the cavity 11 formed in the first member 12 may be wider or more narrow than the cavity 11 formed in the second member 14.

In one embodiment of the present invention, one or more of the sidewalls 13 may include a notch (not shown) formed within the sidewall for receiving a bump or edge of the article of manufacture at or near the corner of the article. Similarly, the cavity 11 of the first member 12 or the second member 14 may include such a notch.

In an embodiment of the present invention, the sidewalls 13 may define the cavity 11 such that the article of manufacture 40 fits snugly within the cavity 11. Alternatively, the sidewalls may be formed such that the article 40 may move within the cavity 11.

In an embodiment of the present invention, the corner protector 10 may be integrally molded as a unitary piece. As will be apparent to those of ordinary skill in the art, the corner protector 10 may be scored with, for example, a high pressure compression point to form the hinge 16. In this embodiment, the first member 12 and the second member 14 are thus connected by the molded hinge (i.e., a living hinge) 16. The corner protector 10 may be molded using known techniques such as, for example, injection molding, and compression molding. Alternatively, in some embodiments, other manufacturing techniques, including, but not limited to, vacuum forming, thermo forming, blister packaging, and/or casting, may be used to form the corner protector 10. In one embodiment, the corner protector 10 and the outer container 30 may be molded as a unitary piece.

In an alternative embodiment, one or more portions of the corner protector 10 may be formed separately. For example, the first member 12 and the second member 14 may be molded separately and subsequently joined by a hinge 16. In this embodiment, the hinge 16 may comprise, for example, tape or other material for creating a flexible seam and connecting the first member 12 and the second member 14.

In one embodiment, the corner protector 10 may comprise a recyclable material, such as, for example, molded pulp, in order to address environmental concerns. As will be apparent to those of ordinary skill in the art, the molding process using pulp generally includes forming a slurry with water, recycled paper, and a binder material. The slurry is then formed into shapes by pressing the slurry through a screen and into a mold. As discussed above, the material may be molded into a variety of forms in order to match the shape of the article 40 and/or outer container 30. Other suitable packaging materials, including, but not limited to, rubber, polypropylene, styrene, and/or poly(ethylene terephthalate) (PETE) and the like may be used. To further alleviate environmental concerns, it is contemplated that the corner protector 10 may be of sufficient strength to be re-usable throughout the supply chain. In this manner, a manufacturer, integrator, vendor, retailer, and/or ultimate user of the article, for example, may re-use the corner protector 10 and limit waste. In one embodiment, the corner protector 10 and the outer container comprise the same material. In one embodiment, the first 12 and second 14 members may be formed from the same material. In alternative embodiments, the first 12 and second 14 members, and/or the hinge 16 may be formed from different materials. For example, in an embodiment in which the first member 12 and the second member 14 may be molded separately and subsequently joined by a hinge 16, the first and second members may be formed from different materials.

In one embodiment, the corner member 10 may be molded to form a hollow structure. In this embodiment, the corner protector 10 may provide a rigid but compressive form having spring-like characteristics by which it deforms under a load, but returns to form when the load is removed. For example, the walls of the corner protector 10 may resist forces but bend inwardly when a force is applied without substantially imparting the force onto the article 40. In this manner, the corner member 10 may help reduce impacts and loads on the article 40. The corner member 10 may be molded to have any desired wall thickness. In one embodiment, the corner member 10 has a uniform wall thickness. Alternatively, the corner member 10 may be molded such that one portion of the corner member has a thicker wall thickness to accommodate a more sensitive portion of the article. In alternative embodiments, the corner protector 10 may be molded such that it comprises a solid form.

Figure 6:
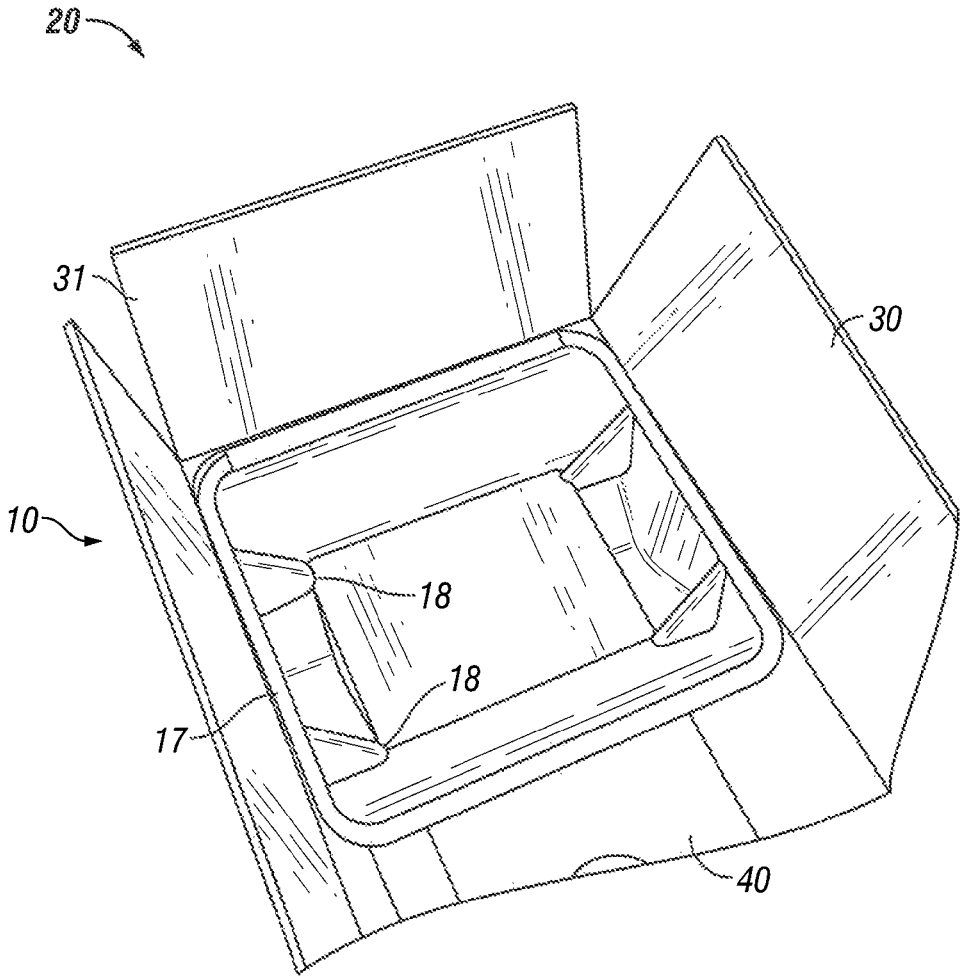
FIG. 6 is a perspective view of a corner protector including strengthening ribs according to an embodiment of the present invention.

With reference to FIG. 6, in one embodiment the corner protector 10 may be molded to include one or more ribs 18 formed on the first member 12 and/or the second member 14 for increased strength. In one embodiment, two ribs 18 may be formed on the first member 12 on either side of the article 40. The size, shape, and location of the ribs 18 may be widely varied to provide the required strength characteristics. In one embodiment, the ribs 18 may comprise a lattice structure to further increase strength.

Figure 5:
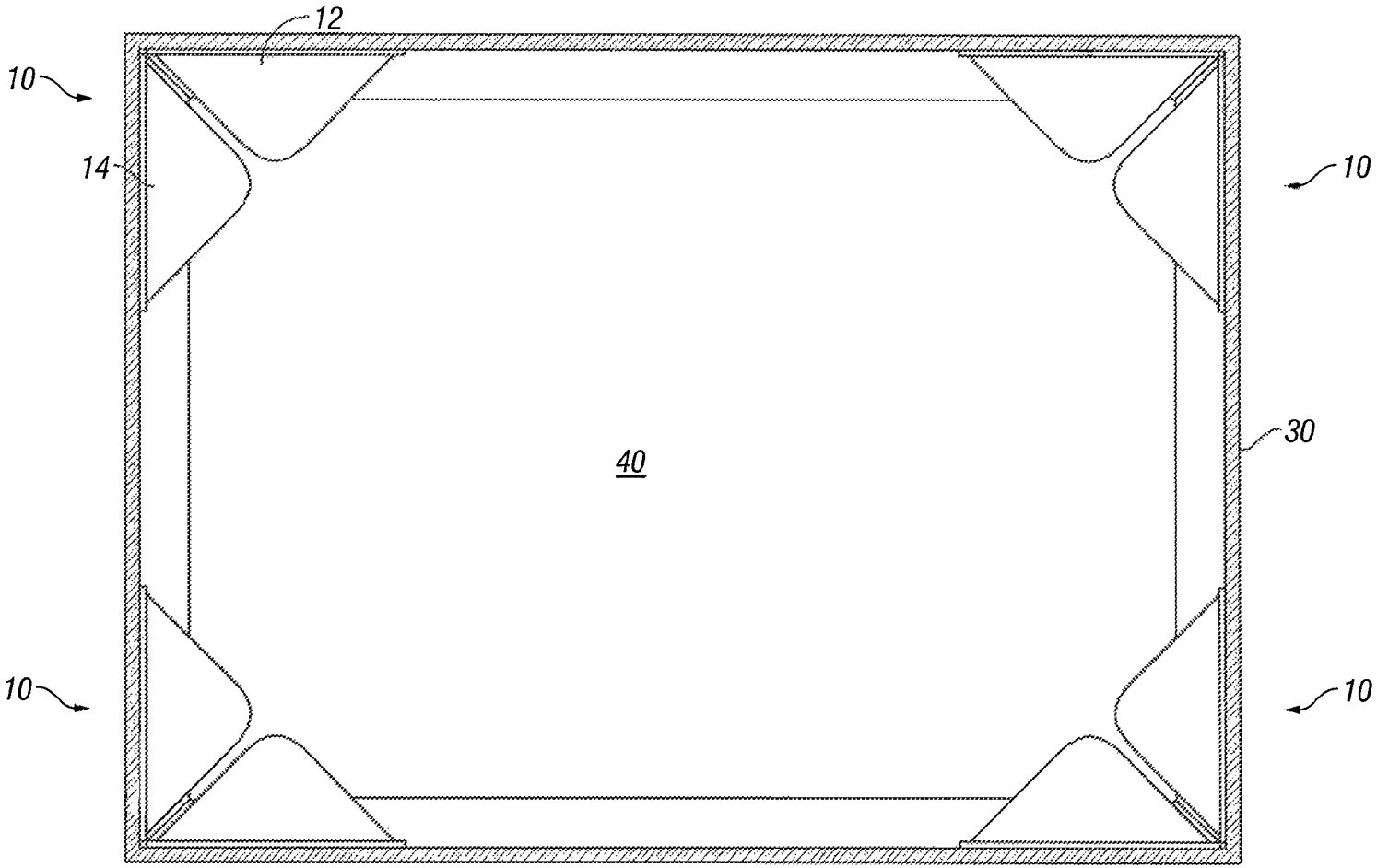
FIG. 5 is a cross-sectional front elevation view of packaging according to an embodiment of the present invention.

With reference to FIGS. 2-5, an exemplary use of a plurality of corner protectors 10 as part of a packaging assembly 20 will now be described. With particular reference to FIG. 5, a corner protector 10 may be disposed snugly about each corner of an article of manufacture 40. The article may be placed in an outer container 30 such that each corner protector 10 is disposed between the corners of the article 40 and the outer container 30, thereby holding the article 40 in its desired position within the outer container 30. The shape of the inner surface(s) of each corner protector 10 may correspond to the shape of the outer surface(s) of the article 40. Similarly, the shape of the outer surface(s) of each corner protector 10 may correspond to the shape of the inner surface(s) of the outer container 30. As such, the shape of each corner protector 10 may permit the outer container 30 to close, while holding the article in its desired position within the container.

The corner protectors 10 may provide an air gap between the article 40 and the outer container 30 on each side of the article. For example, in embodiments where the article 40 and the outer container 30 are rectangular in shape, the corner protectors 10 may provide an air gap between the article and the container on the six sides of the article. When the outer container 30 is subjected to forces, one or more corner protectors 10 may compress under stress without substantially imparting the force onto the article, thereby reducing or preventing damage to the article.

One or more of the corner protectors 10 may be attached to the outer container 30 as discussed above. As shown in FIG. 4, when a flap 31 of the outer container 30 is opened, the first member 12 attached to that flap remains attached to the outer container 30 and is rotated about the hinge 16. The first member 12 is correspondingly pulled away from the article 40, thereby exposing the article and facilitating its removal from the container.

While the invention has been described in terms of several embodiments, there are alterations, permutations, and equivalents, which fall within the scope of this invention. For example, the packaging can be used for items other than electronic devices, and may be used with items not in packaging, or in packaging made of material other than paper or cardboard. It is therefore intended that the following appended claims be interpreted as including all such alterations, permutations, and equivalents as fall with the true spirit and scope of the present invention.

What is claimed is:

1. A packaging assembly, comprising:

an outer container;

an inner container disposed within said outer container, said inner container having at least one corner, the inner container adapted to hold an article; and a corner protector separate from said outer container disposed about a corner of said inner container, the corner protector including:

a first member having two sidewalls defining a first interior cavity therebetween receiving the corner of said inner container, and an angled shoulder extending between the two first member sidewalls, wherein a portion of said first member is attached to said outer container, a second member having two sidewalls defining a second interior cavity therebetween for receiving the corner of said inner container, and an angled shoulder extending between the two second member sidewalls, and a molded hinge connecting said first member and said second member, wherein the angled shoulder of said first member abuts the angled shoulder of said second member aligning with the corner of said inner container, and wherein said first member being attached to said outer container rotates relative to said second member about said molded hinge and said second member remains within said outer container when said outer container is opened to facilitate removal of said inner container from said outer container.

2. The packaging assembly of claim 1, further comprising means for attaching said first member to said outer container.

3. The packaging assembly of claim 2, wherein said means for attaching comprises adhesive.

4. The packaging assembly of claim 1, wherein said first member further comprises a flange for attaching said first member to said outer container.

5. The packaging assembly of claim 1, wherein said first member, said second member, and said molded hinge are molded as a unitary piece.

6. The packaging assembly of claim 1, wherein said first and second members are made by injection molding.

7. The packaging assembly of claim 1, wherein said first and second members are made by compression molding.

8. The packaging assembly of claim 1, wherein said first and second members comprise molded pulp.

9. The packaging assembly of claim 1, wherein said first and second members comprise a material selected from the group consisting of: pulp, rubber, polypropylene, PETE, and styrene.

10. The packaging assembly of claim 1, wherein said second member is not attached to said outer container.

11. A packaging assembly, comprising:

an outer container having a flap;

an inner container disposed within said outer container, said inner container having at least two corners, the inner container adapted to hold an article; and a plurality of corner protectors, each disposed about a corner of said inner container, the corner protector including:

a first member having two sidewalls defining a first interior cavity therebetween for receiving a corner of said inner container, an angled shoulder extending between the two first member sidewalls, and a flange attached to the flap of said outer container, said flange disposed about the perimeter of said first member, a second member having two sidewalls defining a second interior cavity therebetween for receiving the corner of said inner container, and an angled shoulder extending between the two second member sidewalls, wherein said second member is not attached to said outer container, and a hinge connecting said first member and said second member, wherein the angled shoulder of said first member cooperates with the angled shoulder of said second member to align with the corner of said inner container, and wherein said first member being attached to the flap of said outer container rotates about said molded hinge and said second member remains within said outer container when said outer container is opened to facilitate removal of said inner container from said outer container.

12. The packaging assembly of claim 11, wherein each of said corner protectors is molded as a unitary piece.

13. The packaging assembly of claim 11, wherein said corner protectors are injected molded.

14. The packaging assembly of claim 11, wherein said corner protectors comprise molded pulp.

15. The packaging assembly of claim 11, wherein the second member sidewalls are disposed between said outer container and said inner container.

16. The packaging assembly of claim 11, wherein said outer container comprises a box.

17. The packaging assembly of claim 11, wherein said corner protectors are discrete from said outer container and said inner container.

18. The packaging assembly of claim 11, wherein said inner container comprises a rectangular box.

* * * * *

UNITED STATES PATENT AND TRADEMARK OFFICE

CERTIFICATE OF CORRECTION

PATENT NO. : 7,866,478 B2
APPLICATION NO. : 12/047533
DATED : January 11, 2011
INVENTOR(S) : Matthew Dean Rohrbach et al.

It is certified that error appears in the above-identified patent and that said Letters Patent is hereby corrected as shown below:

In column 2, line 62, after "with" insert -- or abut --.

In column 3, line 20-29, delete

"In one embodiment of the present invention, the first member 12 and the second member 14 further include a shoulder 15. As shown in FIG. 2, the shoulders 15 may comprise angled surfaces such that the shoulder 15 of the first member 12 may be adapted to cooperate with or abut the shoulder 15 of the second member 14 when the corner protector 10 is in a closed position about a portion of the article 40. In this embodiment, the shoulders 15 come together to form a corner, and, thus, the first member 12 may be perpendicular to the second member 14."

and insert

-- In one embodiment, the first member 12 may rotate about the hinge 16 while the second member 14 remains disposed between the article 40 and the outer container 30. The flap 31 may be a top flap or side flap of the outer container 30. Alternatively, the flange 17 may be attached to a lid of the outer container 30. In various embodiments, the flange 17 may be formed on the first member 12, the second member 14, or both members. --, therefor.

Signed and Sealed this
Twenty-fifth Day of October, 2011

David J. Kappos

David J. Kappos
*Director of the United States Patent and Trademark Office*